United States Patent [19]

Hayashi et al.

[11] 4,108,662

[45] Aug. 22, 1978

[54] PROCESS FOR DEVELOPING PHOTOGRAPHIC LIGHT-SENSITIVE MATERIALS FOR THE GRAPHIC ARTS

[75] Inventors: Katsumi Hayashi; Yoo Iijima; Eiichi Okutsu, all of Minami Ashigara, Japan

[73] Assignee: Fuji Photo Film Co., Ltd., Minami Ashigara, Japan

[21] Appl. No.: 762,594

[22] Filed: Jan. 26, 1977

[30] Foreign Application Priority Data

Jan. 28, 1976 [JP] Japan ..... 51-8230

[51] Int. Cl.[2] ..... G03C 5/30

[52] U.S. Cl. ..... 96/66.5; 96/66 R

[58] Field of Search ..... 96/66 R, 66.3, 66.4, 96/66.5, 33, 107, 109, 29 L

[56] References Cited

U.S. PATENT DOCUMENTS

| | | | |
|---|---|---|---|
| 3,053,657 | 9/1962 | Goodchild et al. | 96/66 R |
| 3,190,752 | 6/1965 | Hayakawa et al. | 96/109 |
| 3,333,959 | 8/1967 | Hayakawa et al. | 96/109 |
| 3,345,175 | 10/1967 | Hayakawa et al. | 96/109 |
| 3,573,913 | 4/1971 | Willems et al. | 96/66.3 |
| 3,732,104 | 5/1973 | Vandenabeele et al. | 96/66.5 |
| 3,782,945 | 1/1974 | Shimamura et al. | 96/66.5 |
| 3,827,886 | 8/1974 | Ishihra et al. | 96/109 |
| 3,832,180 | 8/1974 | Douglas | 96/66.3 |
| 3,891,442 | 6/1975 | Beavers | 96/66.3 |
| 3,981,733 | 9/1976 | Van Dam et al. | 96/109 |

*Primary Examiner*—Mary F. Kelley

*Attorney, Agent, or Firm*—Sughrue, Rothwell, Mion, Zinn and Macpeak

[57] ABSTRACT

A process for developing a photographic light-sensitive material for the graphic arts which comprises infectiously developing a silver halide light-sensitive material comprising a support having coated thereon a silver halide emulsion layer containing at least 60 mol% silver chloride with an infectious developing solution containing a compound represented by the general formula (I):

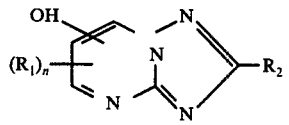

(I)

wherein $R_1$ and $R_2$, which may be the same or different, each is a hydrogen atom, an alkyl group having 1 to 4 carbon atoms, an aryl group having up to 12 carbon atoms, or a halogen atom; and *n* is 1 to 2.

6 Claims, No Drawings

PROCESS FOR DEVELOPING PHOTOGRAPHIC LIGHT-SENSITIVE MATERIALS FOR THE GRAPHIC ARTS

BACKGROUND OF THE INVENTION

1. Field of the Invention

The present invention relates to a process for developing a light-sensitive photographic material for photographic printing plates useful in the graphic arts, and more particularly, relates to a process for developing a litho-type light-sensitive material without the formation of aerial fog which occurs when the light-sensitive material on transfer from a developing solution comes into contact with air.

2. Description of the Prior Art

In litho-type silver halide light-sensitive materials which are used for making photographic printing plates useful in the graphic arts, lithographic films which are used for converting continuous tone images of the originals to be printed into dot images, whereby the density variation of the continuous tone images is converted into area variations of dot images, and lithographic line films which are used for the originals to be printed and having line images are known.

These litho-type light-sensitive materials are generally developed with a so-called infectious developing solution (hereinafter, described as "lithographic development") in order to obtain dot or line images having higher contrast and higher density.

Examples of development processes are tray processings which are carried out by manually developing the exposed photographic materials in plate-like vessels filled with the developing solution and automatic machine developing processings which are carried out using automatic developing machines as disclosed in U.S. Pat. Nos. 3,025,779, 3,078,024, 3,122,086, 3,149,551, 3,156,173, 3,224,356 and 3,573,914.

In the developing processings, fog occurs because photographic materials are contacted with air during or after the processings or when they are transported into the following step (e.g., fixing step).

This type of fog is called "aerial fog," and particularly aerial fog often occurs in automatic machine processings because photographic materials ae contacted with air for several seconds to several tens of seconds when they are transported by means of the crossover rolls in the apparatus.

If aerial fog occurs, the minimum density of the dot or line images is increased, and effective density of the images (the difference between the maximum density and the minimum density) is reduced, and, as a result, image sharpness, tone reproducibility and resolving power are reduced. Therefore, desired photographic printing plates cannot be obtained when this occurs. Particularly, the image contrast is reduced and the dot quality is deteriorated when this happens and the exposure time for printing images from photographic plates to printing plates is longer.

SUMMARY OF THE INVENTION

Therefore, an object of this invention is to provide a process for developing litho-type silver halide photographic materials with a litho-type developing solution where the formation of aerial fog does not occur.

A second object of this invention is to provide a development process where the photographic properties of litho-type silver halide photographic materials are not adversely affected and where aerial fog does not occur.

A third object of this invention is to provide a process for forming good photographic printing plates not affected by aerial fog.

A fourth object of this invention is to provide a developing solution with which aerial fog does not occur when litho-type silver halide photographic light-sensitive materials are developed therewith.

A fifth object of this invention is to provide a method for preventing aerial fog where lithographic light-sensitive materials are developed with a lithographic developing solution.

The objects of this invention are attained by the method of this invention comprising developing a photographic light-sensitive material for the graphic arts with an infectious developing solution containing a compound represented by the following general formula (I):

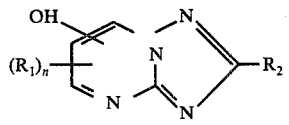

(I)

wherein $R_1$ and $R_2$, which may be the same or different, each is a hydrogen atom, an alkyl group having 1 to 4 carbon atoms, an aryl group having 6 to 12 carbon atoms or a halogen atom (in which the alkyl and aryl group can be substituted with one or more of a hydroxy group, a carboxy group, a halogen atom or an alkyl group having up to 3 carbon atoms), and $n$ is 1 or 2.

DETAILED DESCRIPTION OF THE INVENTION

Suitable examples of alkyl groups for $R_1$ and $R_2$ in the general formula (I) above include a methyl group, an ethyl group and the like. Suitable examples of aryl groups for $R_1$ and $R_2$ include a phenyl group and the like. Suitable examples of halogen atoms for $R_1$ and $R_2$ in the general formula (I) above include a chlorine atom, a bromine atom and the like. Suitable examples of substituents for the alkyl group and aryl group for $R_1$ and $R_2$ as described above include a halogen atom such as chlorine and bromine and an alkyl group such as methyl and ethyl.

Some representative examples of the compounds represented by the formula (I) above are shown below:

Compound Examples (1) 4-Hydroxy-6-methyl-1,3,3*a*,7-tetraazaindene
(2) 4-Hydroxy-1,3,3*a*,7-tetraazaindene
(3) 4-Hydroxy-6-phenyl-1,3,3*a*,7-tetraazaindene
(4) 4-Methyl-6-hydroxy-1,3,3*a*,7-tetraazaindene
(5) 4-Hydroxy-6-benzyl-1,3,3*a*,7-tetraazaindene
(6) 2-Methyl-4-hydroxy-6-butyl-1,3,3*a*,7-tetraazaindene
(7) 4-Hydroxy-6-carboxymethyl-1,3,3*a*,7-tetraazaindene
(8) 2-Hydroxymethyl-4-hydroxy-6-phenyl-1,3,3*a*,7-tetraazaindene
(9) 2-(4-Chloro-2-methyl-phenoxymethyl)-4-hydroxy-1,3,3*a*,7-tetraazaindene
(10) 2-Methyl-4-hydroxy-6-ethoxycarbonylmethyl-1,3,3*a*,7-tetraazaindene Of these compounds of the formula (I) shown above, those having a hydroxyl group at the 4-position of the ring are preferred.

These compounds of the formula (I) are incorporated directly into a litho-type developing solution and/or into a solution used for replenishing the developing solution which is added to the developing solution (hereinafter, "replenishing solution"). These compounds can be synthesized by the methods as disclosed in Japanese Patent Publications Nos. 18102/71 and 2533/69 (corresponding to U.S. Pat. No. 3,462,272).

The amount of the compound of this invention added to a developing solution and/or a replenishing solution is about 10 to about 500 mg, preferably 30 to 200 mg, per liter of thedeveloping or replenishing solution.

It is well known that the compound of the formula (I) used in this invention can be added to a silver halide emulsion, but the purpose thereof is different from preventing aerial fog of litho-type light-sensitive materials. Therefore, the unexpected results which are obtained in this invention by adding the compound of the formula (I) to a litho-type developing solution are not known in the art.

A litho-type or lithographic developing solution is an infectious developing solution and is basically composed of an o- or p-dihydroxybenzene, an alkali, a small amount of free sulfite ion and a sulfite ion buffer. Specific examples of suitable infectious developing solutions are described in detail in U.S. Pat. No. 3,030,209.

The o- or p-dihydroxybenzene used as a developing agent can be selected from a wide variety of those compounds which are known in the photographic field. Examples of suitable developing agents are hydroquinone, chlorohydroquinone, bromohydroquinone, isopropylhydroquinone, toluhydroquinone, methylhydroquinone, 2,3-dichlorohydroquinone and 2,5-dimethylhydroquinone. Of these developing agents, hydroquinone is particularly preferred. These developing agents can be used individually or in combination. The amount of the developing agent generally employed is about 1 to about 100 g, preferably 5 to 80 g, per liter of developing solution.

A sulfite ion buffer is used in such an amount that the concentration of sulfite ion in the developing solution is kept substantially constant. Examples of suitable sulfite ion buffers can include an aldehyde-alkali metal-bisulfite adduct (e.g., a formaldehyde-sodium bisulfite adduct), a ketone-alkali metal-bisulfite adduct (e.g., an acetone-sodium bisulfite adduct) and a carbonyl bisulfite-amine condensation product (e.g., sodium bis(2-hydroxyethyl)aminomethane sulfonate). A suitable amount of the sulfite ion buffer is about 13 to about 130 g per liter of the developing solution.

An alkali is added to the developing solution so that the developing solution is kept alkaline, preferably a pH of not less than about 9 (particularly, to a pH of 9.7 to 11.5). Accordingly, the amount and kind of alkali used is not limited to any specific compounds but suitable examples which can be used include sodium carbonate, potassium carbonate, sodium hydroxide, etc.

An alkali metal sulfite such as sodium sulfite can be incorporated in the developing solution used in the process of this invention to control the concentration of the free sulfite ion. A suitable amount of the alkali metal sulfite is generally up to about 5 g per liter of the developer, particularly up to 3 g. The amount of the alkali metal sulfite can be more than 5 g per liter of the developer in some cases.

In many cases, it is preferred that the developing solution of the invention contains an alkali metal halide (e.g., sodium bromide, potassium bromide or other bromides) as a development controlling agent. A suitable amount of the alkali metal halide is about 0.01 to about 10 g, preferably 0.1 to 5 g, per liter of the developing solution.

The developing solution of this invention can further contain a water soluble acid (e.g., acetic acid or boric acid), an alkali (e.g., sodium hydroxide), salts (e.g., sodium carbonate) etc., which act as a pH buffer. Some alkalis have the function of adjusting the pH of the developing solution to an alkaline pH, and also function as a pH buffer and a development controlling agent.

In a litho-type developing solution and a replenishing solution therefor, potassium ion and sodium ion are present. In this case, if the ratio of the potassium ion to the sum of the potassium ion and the sodium ion is not less than about one-half, the formation of aerial fog occurs more easily. Where the compound of the formula (I) used in this invention is present in the developing solution having such a composition, better results in preventing the formation of aerial fog can be obtained.

The other components to be added to the developing solution of the invention can include preservatives such as ascorbic acid or kojic acid, anti-foggants such as benzotriazole or 1-phenyl-5-mercaptotetrazole, and organic solvents such as triethylene glycol, dimethylformamide or methanol. In order to enhance the storage property of the developer, an alkanolamine as disclosed in Japanese patent application (OPI) 44746/74 (corresponding to British Pat. No. 1,396,665 and German patent application (OLS) No. 2,344,074) can be added to the developer, e.g., in an amount of about 0.1 to about 0.8 mol/l of developer solution.

The thus prepared developing solution employed in this invention includes each component in use, and so the components of the developing solution can be separated into two or more parts before use and combined on use. For example, a concentrate containing the developing agent dissolved therein and a separate concentrate containing an alkali can be prepared before use, and the two concentrates are then diluted and mixed on use.

Where litho-type light-sensitive materials are processed with a litho-type developing solution by means of an automatic developing machine in the invention, the development temperature generally employed is about 20° to about 50° C, particularly 25° to 40° C, and the developing time is about 10 seconds to about 250 seconds, particularly 10 seconds to 150 seconds. The conditions employed in the fixing step, the washing step and the drying step are not limited and so those which have usually been employed in an automatic developing machine in this art, e.g., as disclosed in German patent application (OLS) No. 2,343,242, particularly Examples 4 and 6 thereof, can be utilized in the process of the invention.

Litho-type photographic light-sensitive materials are generally developed with a developing solution containing a small amount of sulfite ion to improve the dot quality. In this case, it is known that the dot quality can be further improved by incorporating a polyethylene oxide compound in a light-sensitive layer of the litho-type photographic light-sensitive materials. Known compounds, which can be used are polyethylene oxide and a condensation product of polyethylene oxide with aliphatic alcohols, glycols, fatty acids, aliphatic amines, phenols or dehydrated cyclic compounds of hexitol derivatives, which are disclosed in U.S. Pat. Nos. 3,288,612, 3,345,175, 3,294,540 and 3,516,830.

The silver halide emulsion employed in the light-sensitive materials to which the process of this invention is applicable can be prepared by a neutral method, an acid method, a single jet method, a double jet method or a controlled double jet method as disclosed in C.E.K. Mees & T.H. James, *The Theory of the Photographic Process* 3rd Ed. pages 31 to 43, Macmillan Co., New York, (1967) and P. Grafkides, *Chimie Photographique* pages 251 to 308, Paul Montel Co., Paris, (1957).

Examples of silver halides which can be employed in these light-sensitive materials include silver chlorobromide and silver chloroiodobromide containing at least about 60 mol% (more preferably, not less than 75 mol%) of silver chloride and about 0 to 5 mol% of silver iodide is preferably used.

The sensitivity of the silver halide emulsion can be increased without increasing the size of the silver halide grains using a gold compound such as chloroaurate or auric trichloride, a noble metal salt such as rhodium or iridium, or a reducing compound such as sulfur compounds capable of forming silver sulfide by reaction with a silver salt, stannous salts or amines.

The binder for the silver halide can include gelatin, modified gelatins, gelatin derivatives and synthetic hydrophilic polymers.

Polymer latexes such as homo- or copolymers of alkyl acrylates, alkyl methacrylates, acrylic acid or glycidyl acrylates as disclosed in Japanese patent publication No. 5331/70 can be added to the silver halide emulsion layer or the other layers for purposes of improving dimensional stability, improving the physical properties of the layer, etc.

Any anti-foggants such as 4-hydroxy-6-methyl-1,3,3a,7-tetraazaindene, 3-methylbenzthiazole, 1-phenyl-5-mercaptotetrazole, other heterocyclic compounds, mercury-containing compounds or mercapto compounds as are well known in the art can be employed in the photographic emulsion of the light-sensitive materials to which the invention is applicable to prevent fog formation during the preparation of the emulsion and during the storage of the emulsion and the photographic materials.

However, even if these anti-foggants are incorporated into a silver halide emulsion, aerial fog cannot be prevented. In some cases, where those compounds which can prevent aerial fog are added to the silver halide emulsion layer, they often adversely affect photographic properties, for example, cause a pressure-sensitization or pressure-desensitization, decrease the dot quality, decrease the contrast or render the sensitivity unstable.

A litho-type silver halide emulsion employed in the invention can be orthochromatically or panchromatically spectrally sensitized or supersensitized using cyanine dyes such as cyanine dyes, merocyanine dyes or carbocyanine dyes, individually or in combination, or in combination with styryl dyes.

Any known hardening agents can be used in this invention. Suitable examples of these hardening agents are aldehyde compounds, ketone compounds, reactive halogen-containing compounds (e.g., 2-hydroxy-4,6-dichloro-1,3,5-triazine), reactive olefin-containing compounds, N-methylol compounds, aziridine compounds and carbodiimide compounds.

A surface active agent can be added to the photographic emulsion used in the invention as a coating aid or to improve the photographic properties. Examples of suitable surface active agents include natural surface active agents such as saponin, nonionic surface active agents such as an alkylene oxide type, a glycerol type or glycidol type surface active agents, acidic group-containing anionic surface active agents such as those containing a carboxylic acid, a sulfonic acid, a phosphoric acid, a sulfate ester group or a phosphate ester group, amphoteric surface active agents such as sulfuric acid esters or phosphoric acid esters of amino acids or aminosulfonic acids, aminoalcohols, etc. Other suitable additives for silver halide emulsions and the processes therefor are disclosed in *Product Licensing Index,* Vol. 92, pages 107 to 110, (1971).

A photographic emulsion used in the light-sensitive materials to which the process of this invention is applicable can be coated on a flexible support of which the dimensional stability does not markedly change during processings, and examples include cellulose acetate films, polyethylene terephthalate films, polycarbonate films and polystyrene films.

In this invention, exposure for obtaining photographic images can be carried out using conventional methods employed in the art. That is, a tungsten lamp, a carbon arc lamp, a mercury lamp, a fluorescent lamp, a xenon arc lamp, a xenon flash lamp, a cathode ray tube flying spot, a glow tube, a laser (e.g., argon laser) and light emitting diode can be used as a light source. A suitable exposure time is about 1/1,000 second to several 10's of seconds, but can be shorter than 1/1,000 (e.g., $1/10^6$ second to $1/10^4$ second). If necessary, the range of the wavelength of the light used for the exposure can be selected by using a color filter.

The invention will be illustrated in more detail by reference to the following Examples. Unless otherwise indicated herein, all parts, percents, ratios and the like are by weight.

EXAMPLE 1

A silver halide emulsion containing 80 mol% of silver chloride, 19.5 mol% of silver bromide and 0.5 mol% of silver iodide was sensitized using gold sensitization and sulfur sensitization. To the silver halide emulsion, 3-carboxymethyl-5-[2-(3-ethylthiazolinidene)ethylidene]rhodamine (spectral sensitizer, 100 mg/mol Ag), polyoxyethylene nonylphenylether (development accelerator, 600 mg/mol Ag), $(C_2H_5)_2NCH_2CH_2CH_2CH—(CH_3)NHCONHC_6H_5$ (development accelerator, 500 mg/mol Ag), mucochloric acid (hardening agent, 800 mg/mol Ag) and a polybutyl methacrylate latex (40 g/mol Ag) were added in this order, and then the photographic emulsion was coated (5 g/m$^2$ of silver halide) on a polyethylene terephthalate film to provide a photographic material.

The photographic material was exposed to a sensitometric exposure through a magenta contact screen, and then was subjected to tray-development using the developing solution shown in Table 1 below.

Table 1

| Developing Composition | Developing Solution I | | Developing Solution II | |
|---|---|---|---|---|
| Sodium Sulfite | 1.5 | g | 1.5 | g |
| Hydroquinone | 17 | g | 17 | g |
| Formaldehyde-Sodium Bisulfite Adduct | 60 | g | 60 | g |
| Sodium Carbonate (anhydrous) | | — | 60 | g |
| Sodium Bicarbonate (anhydrous) | 15 | g | 15 | g |
| Potassium Bromide Carbonate (anhydrous) | 70 | g | | — |
| Potassium Bromide | 1 | g | 1 | g |

Table 1-continued

| Developing Composition | Developing Solution I | | Developing Solution II | |
|---|---|---|---|---|
| Water to make | 1 | 1 | 1 | 1 |

The development was carried out for 1 minute and 45 seconds at 27° C, in which one sample was developed continuously for 1 minute and 45 seconds and the other sample was developed for 1 minute and 30 seconds and then was placed for 15 seconds in air, followed by a fixing step.

The results obtained are shown in Table 2 below.

Table 2

| Run No. | Developing Solution | Compound(1) (mg/l)* | Developing Time | Fog | Dot Quality | Dot Gradation | Sensitivity |
|---|---|---|---|---|---|---|---|
| 1 | I | — | 1'45" | 0.08 | B | 1.1 | 100 |
| 2 | I | — | 1'30"+15" | 0.40 | E | 1.4 | 90 |
| 3 | II | — | 1'45" | 0.04 | B | 1.1 | 100 |
| 4 | II | — | 1'40"+15" | 0.25 | D | 1.3 | 90 |
| 5 | I | 50 | " | 0.01 | A | 1.0 | 100 |
| 6 | I | 1,000 | " | 0.01 | C | 0.9 | 85 |
| 7 | II | 50 | " | 0.01 | B | 0.9 | 95 |

*in the developing solution

In Table 2, Run Nos. 1 to 4 and 6 were for the purposes of comparison and Run Nos. 5 and 7 correspond to the invention.

In Table 2, a developing time of 1'45" means that the photographic materials were placed in the developing solution for this length of time for development, and a developing time of 1'30" + 15" means that the photographic materials were placed for 1'30" in the developing solution for this length of time for development and contacted with air for 15".

The dot quality was measured visually by means of a microscope having a magnification of 100 times, and was evaluated using grades of A to E in which "A" was the best, "C" was practically allowable and "E" was the worst.

The dot gradation was represented by the logarithm (log E) of the exposure amount (E) from a dot area 0% to a dot area 100%.

The sensitivity is a relative value to Run No. 1 of which a sensitivity of 100 is the logarithmic value of the reciprocal of the exposure amount necessary for obtaining a photographic density of fog + 1.50.

As is apparent from the results in Table 2, when Compound (1) is added to Developing Solution I and Developing Solution II, aerial fog can be prevented. Particularly, the result is marked where Compound (1) is added to Developing Solution I.

EXAMPLE 2

In this Example, two photographic materials were used. One was the same as described in Example 1 (Photographic Material "*a*") and the other was prepared using the same procedure as in Example 1 except that 0.5 g per mol of silver halide of Compound (1) was added to the silver halide emulsion after the completion of the ripening thereof (Photographic Material "*b*").

The developing solution employed was the same as Developing Solution I in Example 1. Development was carried out for 1 minute and 45 seconds at 27° C using an automatic developing machine (trade name: FG-14L manufactured by the Fuji Photo Film Co., Ltd.), and the air exposure time of the photographic materials was about 20 seconds.

Table 3

| | Run No. 11 (Comparison) | 12 (Invention) | 13 (Comparison) | 14 (Invention) |
|---|---|---|---|---|
| Photographic Material | "a" | "a" | "b" | "b" |
| Compound (1) (mg/l)* | — | 50 | — | 50 |
| Fog | 0.42 | 0.02 | 0.38 | 0.02 |
| Dot Quality | E | A | D | A |
| Dot Gradation | 1.4 | 1.0 | 1.2 | 1.0 |
| Sensitivity | 95 | 105 | 90 | 95 |

*In developing solution

As is apparent from the results in Table 3, where Compound (1) is not present in the Developing Solution I (Run Nos. 11 and 13), aerial fog is generated to a marked extent. Even if Compound (1) is present in the photographic material (Run No. 13), aerial fog cannot be prevented.

While the invention has been described in detail and with reference to specific embodiments thereof, it will be apparent to one skilled in the art that various changes and modifications can be made therein without departing from the spirit and scope thereof.

What is claimed is:

1. A process for developing a photographic light-sensitive material for the graphic arts which comprises image-wise exposing and infectiously developing a silver halide light-sensitive material comprising a support having coated thereon a silver halide emulsion layer containing at least 60 mol% silver chloride with an infectious developing solution comprising (1) a hydroquinone, (2) an alkali, (3) up to 5 g/l of developer of an alkali metal sulfite salt, (4) an aldehyde-alkali metal-bisulfite adduct, and (5) a compound represented by the general formula (I):

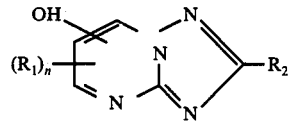

(I)

wherein $R_1$ and $R_2$, which may be the same or different, each is a hydrogen atom, an alkyl group having 1 to 4 carbon atoms, an aryl group having up to 12 carbon atoms, or a halogen atom; and n is 1 to 2; and said developer containing potassium ion and sodium ion in a ratio of potassium ion to the sum of potassium and sodium ion of not less than about one-half.

2. The process of claim 1, wherein said alkyl group is an unsubstituted alkyl group or an alkyl group substituted with one or more of a hydroxy group, a carboxy group or a halogen atom and said aryl group is an unsubstituted aryl group or an aryl group substituted with one or more of a hydroxy group a carboxy group, a halogen atom or an alkyl group having up to 3 carbon atoms.

3. The process of claim 1, wherein said compound represented by the general formula (I) is 4-hydroxy-6-methyl-1,3,3a,7-tetraazaindene, 4-hydroxy-1,3,3a,7-tetraazaindene, 4-hydroxy-6-phenyl-1,3,3a,7-tetraazaindene, 4-methyl-6hydroxy-1,3,3a,7-tetraazaindene, 4-hydroxy-6-benzyl-1,3,3a,7-tetraazaindene, 2-methyl-4-hydroxy-6-butyl-1,3,3a,7-tetraazaindene, 4-hydroxy-6-carboxymethyl-1,3,3a,7-tetraazaindene, 2-hydroxymethyl-4-hydroxy-6-phenyl-1,3,3a,7-tetraazaindene, 2-(4-chloro-2-methyl-phenoxymethyl)-4-hydroxy-1,3,3a,7-tetraazaindene or 2-methyl-4-hydroxy-6-ethoxycarbonylmethyl-1,3,3a,7-tetraazaindene.

4. The process of claim 1, wherein said OH group in said compound represented by the general formula (I) is the 4-position of the ring.

5. The process of claim 1, wherein said compound represented by the general formula (I) is present in an amount of about 10 to about 500 mg per liter of said developing solution.

6. The process of claim 5 wherein said compound is 4-hydroxy-6-methyl-1,3,3a,7-tetraazindene.

* * * * *